US006705835B2

(12) United States Patent
Lee

(10) Patent No.: US 6,705,835 B2
(45) Date of Patent: Mar. 16, 2004

(54) ELECTRIC FAN

(76) Inventor: Wen-Tun Lee, No. 182, Sec. 2, Yung Fu Rd., Tainan (TW)

( * ) Notice: Subject to any disclaimer, the term of this patent is extended or adjusted under 35 U.S.C. 154(b) by 24 days.

(21) Appl. No.: 10/138,416

(22) Filed: May 6, 2002

(65) Prior Publication Data

US 2003/0206801 A1 Nov. 6, 2003

(51) Int. Cl.[7] ..... F04D 29/00

(52) U.S. Cl. ..... 416/31; 416/61; 416/146 R; 416/247 R

(58) Field of Search ..... 415/201, 214.1, 415/121.2, 118; 416/61, 146 R, 247 R, 31

(56) References Cited

U.S. PATENT DOCUMENTS 4,177,045 A * 12/1979 Orel ..... 96/16
4,433,985 A * 2/1984 McGee ..... 96/111
5,779,769 A * 7/1998 Jiang ..... 96/55
6,183,200 B1 * 2/2001 Chang ..... 416/146 R

* cited by examiner

*Primary Examiner*—Ninh H. Nguyen
(74) *Attorney, Agent, or Firm*—Rosenberg, Klein & Lee

(57) ABSTRACT

A fan provided with a smoke detector wired to a CPU in a switch to start the fan if smoke detected exceeds a certain level; and an ion generator is provided to generate ions to neutralize substances carrying hazardous cations; a first conductor on a screen holder wired to the CPU and in off-position state is conducted by contacting a second conductor provided on a front screen so that the fan blades are disabled when both conductors are disconnected once the front screen is removed.

3 Claims, 5 Drawing Sheets

ELECTRIC FAN

BACKGROUND OF THE INVENTION (a) Field of the Invention

The present invention relates to an electric fan, and more particularly, to one that detects the level of ambient suspended particles and starts the fan, emits ions and is provided with safety circuit brake feature.

(b) Description of the Prior Art

Air conditioning equipment is required at home and office for feeling comfortable and maintaining air quality. Electric appliances for ventilation and air purification are essentially available in the following types:.

1. Air Conditioner. It functions to regulate indoor temperature, dehumidify, ventilate and filter the air currents. In use, if the cooling/heating temperature is not properly set, the power consumption is excessively high. It is less convenient since the air filter made of sponge or plastic must be periodically removed and washed to clean.

2. Air Purifier. An earlier mechanical dust collector made of a plurality of rough and fine meshes of filter screens to collect dusts in the air in conjunction with a fan to circulate the air. However, extremely minute dusts are still able to penetrate the filter screens to prevent from being collected. Therefore, said mechanical dust collector has been waived for a long time. Recently, electric air purifier to collect dusts in the air has become popular. It operates on static by having parallel conductor plates with DC high voltage for the dust to become cations and negative electrons with the all the dusts carrying cations to be collected on the negative electrode plate and the dust collector provided on the electrode plate. However, the air purifier is weak to circulate the air; and usually a blower must be used if required.

3. Electric Fan. Fan blades rotate as driven by a motor. The electric fan is a must for every family particularly in tropic and sub-tropic areas since the hot summer could extend into the autumn. The electric fan comes available in the following types:

A. Ceiling Fan. Being suspended on the ceiling, the ceiling fan is usually comprised of three fan blades driven by a screened induction motor and contains variable contacts switch, current resistive coils and a speed regulator also functioning as a switch mounted on the wall at where accessible. However, the ceiling fan is good for air circulation without filtration and dehumidifying effects. Besides, it is not an easy task to clean the fan blades.

B. Stand Fan. Standing alone on the floor, the stand fan rotates without the necessity to move its stand, various control switches may be mounted to its stand and base, and allows readjustment of its height. However, it also fails to filter and dehumidify the air since it only cools the ambient temperature by circulating the air.

C. Wall-mounted Fan. A wall-mounted fan has its speed regulator and the fan blade separately provided with the former located at where accessible to facilitate the control. In some models, a rope is provided to control the speed regulator built in the wall mounted fan. Again, it does not provide air filter and dehumidification. Additionally, it is time and efforts consuming in cleaning the fan blades.

Nonetheless, the electric fan is still very popular for cheaper price and less power consuming though it fails the function of filtering and dehumidifying the air.

However, a further examination into the design of the electric fan of the prior art indicates that the insufficiency in its automation control. The electric fan is generally operated with a knob, push bottom or contact type of switch to start or stop the operation of the fan blades. It fails to achieve automated air cooling depending on the quality of the ambient air. Furthermore, it fails to purify the air and thus is difficult to meet consumer needs. Upon maintaining the electric fan, the screens and the fan blades must be removed. When the front screen is removed, the exposed fan blades may be actuated by accidentally touching the switch resulting in risk of cutting the hands of the user.

SUMMARY OF THE INVENTION

The primary purpose of the present invention is to provide an electric fan that detects the level of the ambient suspended particles and to automatically start the fan soonest the suspended particles reaches a certain level; is incorporated with an ion generator and provides safety power off function; characterized by that:

A smoke detector provided to the fan to detect density of suspended particles in the ambient air is wired to a CPU of a switch for control so that in case of higher density of suspended particles detected in the ambient air, the fan blades are automatically started to rotate for air cooling by the CPU; an ion generator is provided on the fan screen and a first conductor provided on the casing of the ion generator and connected to the CPU indicating off-position state; the first conductor is split in two ways respectively extending to an edge of a screen holder to form two contacts; a second conductor is provided on a rim where the screen holder engages a front screen in relation to those two contacts to form a conduction passage for ions generated from the ion generator to neutralize substance carrying hazardous cations along air circulation route created by the rotating fan blades so to achieve sterilization purpose. Once the front screen is removed, the CPU is in off-position due to the second conductor on the rim to disable the fan blades.

DETAILED DESCRIPTION OF THE PREFERRED EMBODIMENTS

Figure 1:
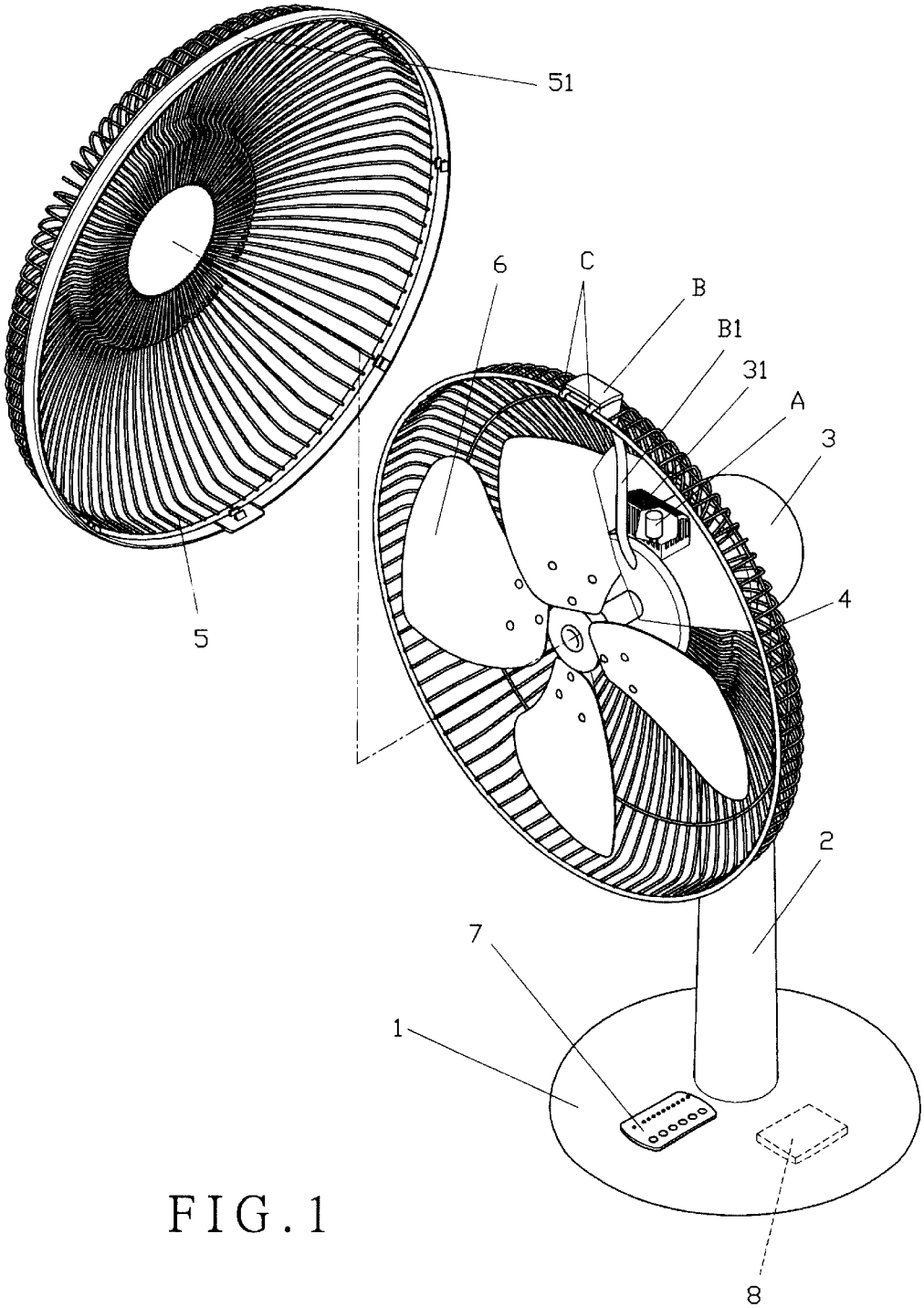
FIG. 1 FIG. 1 is a perspective view showing a preferred embodiment of the present invention.

Referring to FIG. 1, a preferred embodiment of the present invention relates to a stand fan essentially comprised of a base (1), a stand (2) a motor housing (3), a screen holder (4) in front of the motor housing (3) and a front screen (5), a plurality of fan blades (6) contained in the screen holder (4) and the front screen (5) fixed to a spindle of the motor (3), and a touch panel (7) provided on the base (1); however, it is to be noted here that the stand fan is not the only type applicable for the present invention since other types of fans may be also adapted with structural characteristics to be disclosed below.

Figure 2:
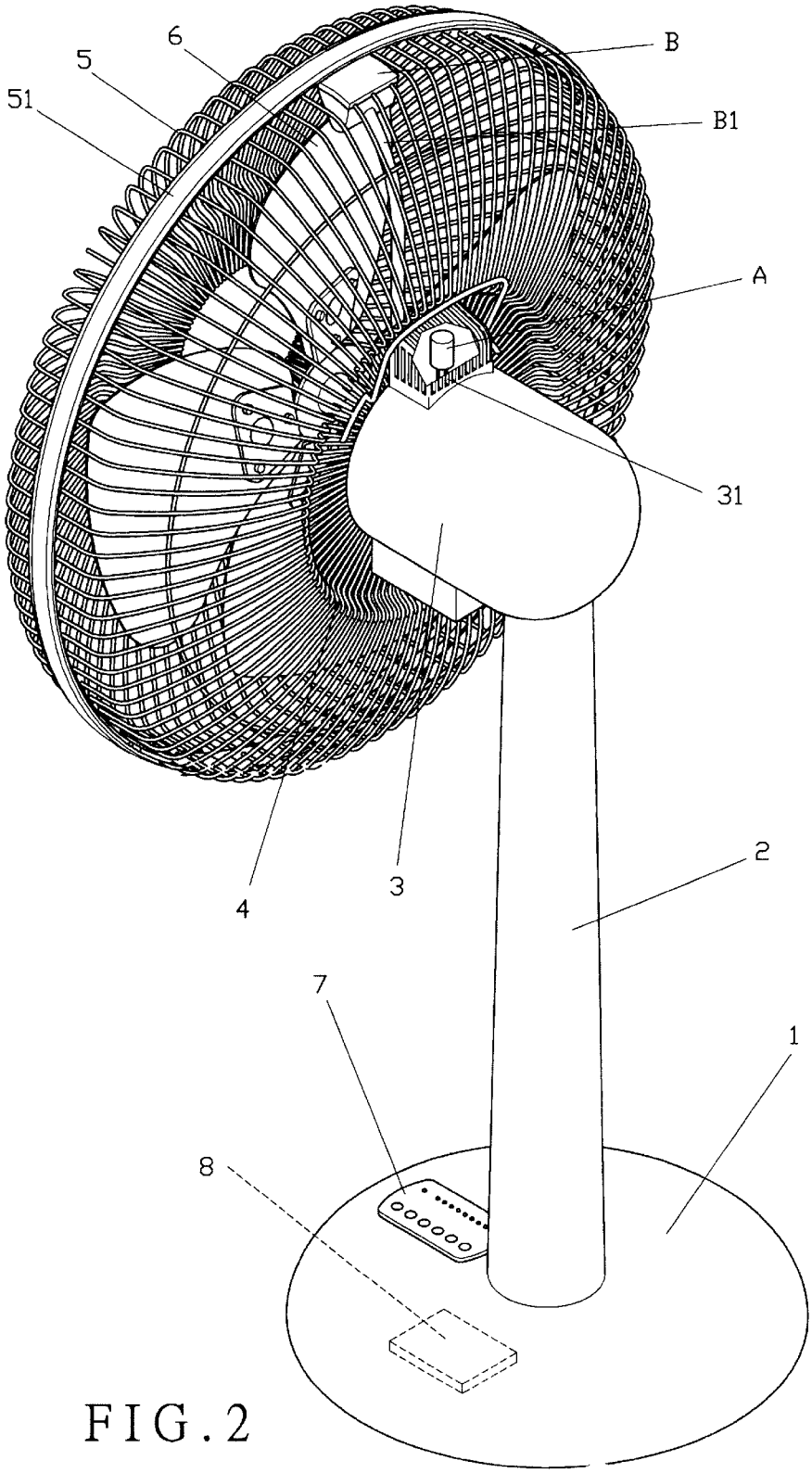
FIG. 2 is a rear view of an assembly of the preferred embodiment of the present invention.

Referring to FIG. 2, a smoke detector (A) is provided on the front upper portion of the motor housing (3) to detect density of suspended particles in the ambient air. The smoke detector (A) is protected in a grill cover (31), which permits the air to flow through the smoke detector (A) and is integrated with the motor housing (3). The smoker detector (3) is wired to a CPU (8) in the base (1). The CPU (8) is connected to the circuit of the touch panel (7), which controls fan operation.

An ion generator (B) provided on the screen holder (4) of the fan has its casing fixed between grills of the screen holder (4) and its lower end connected to a line conduit (B1) to accommodate electric core.

Figure 3:
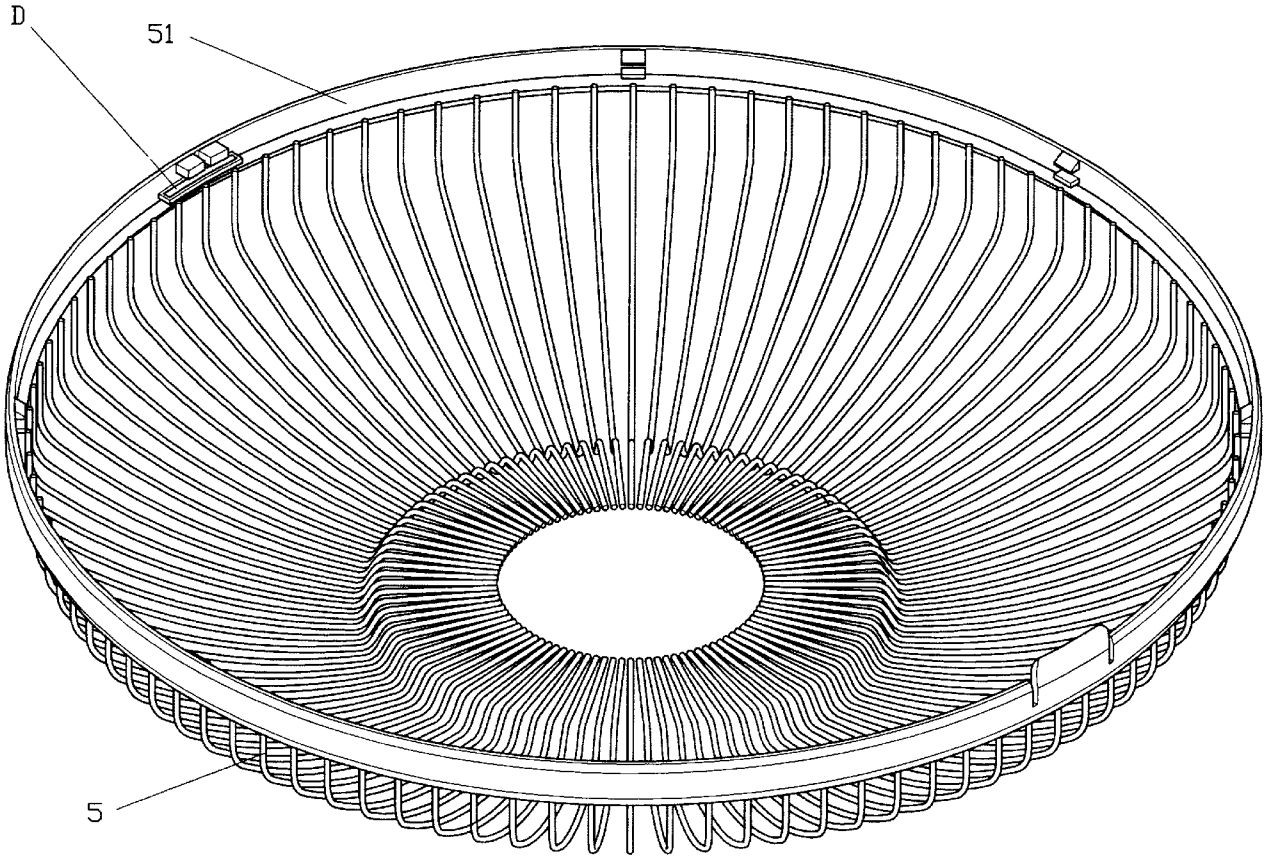
FIG. 3 is a view showing a local part of the preferred embodiment of the present invention.

A first conductor (C) provided on the casing of the ion generator (B) is wired to the CPU (8) and is in off-position under normal condition. The first conductor (C) is divided into two ends extending to reach the edge of the screen holder (4) to form two contacts. As illustrated in FIG. 3, the circular rim where the front screen (5) is abutted to the screen holder (4) is separately provided with a second conductor (D) in relation to the first conductor (C) so to form a conduction passage when both of the first conductor (C) and the second conductor (D) contact each other.

Figures 4, 4A:
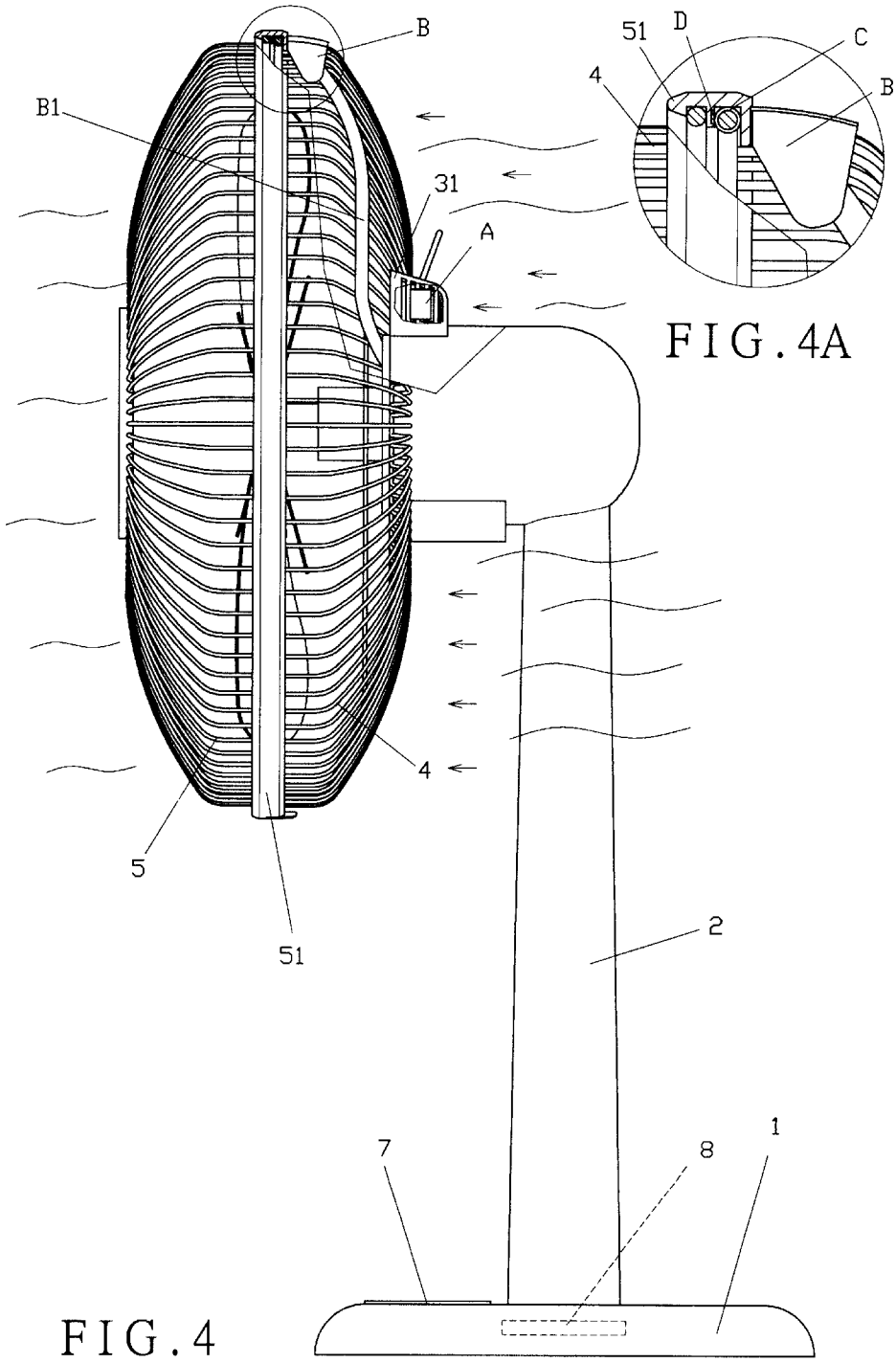
FIG. 4 is a view showing that the preferred embodiment of the present invention in operation.
FIG. 4A is a partially enlarged cross-sectional view of FIG. 4.

Referring to FIG. 4, the fan is set in a status that the fan blades (6) have not yet activated. Once the density of suspended particles gets higher (e.g. someone is smoking), the smoke detector (A) on the motor housing (3) detects such elevated density of suspended particles and transmit signals through a control line to the CPU (8). Upon picking up the signals, the CPU (8) gives commands to automatically start the fan blades (6) to rotate in automatic air circulation mode. Meanwhile, the ion generator (B) on the screen holder (4) starts to generate ions to neutralize substances carrying hazardous cations for air sterilization purpose along air circulation route defined by the rotation of the fan blades.

Whereas a conduction of contact passage is formed by the first conductor (C) having two contacts on the screen holder (4) and the second conductor (D) on the rim (5) of the front screen (5), the second conductor (D) is disconnected from both contacts of the first conductor (C) to become in off-position once the front screen (5) is removed. Meanwhile, the CPU (8) prevents the fan blades (6) from being activated due to that the first conductor (C) is in off-position to avoid risks of activating the fan blades (6) by an accidental touch of the switch.

Figure 5:
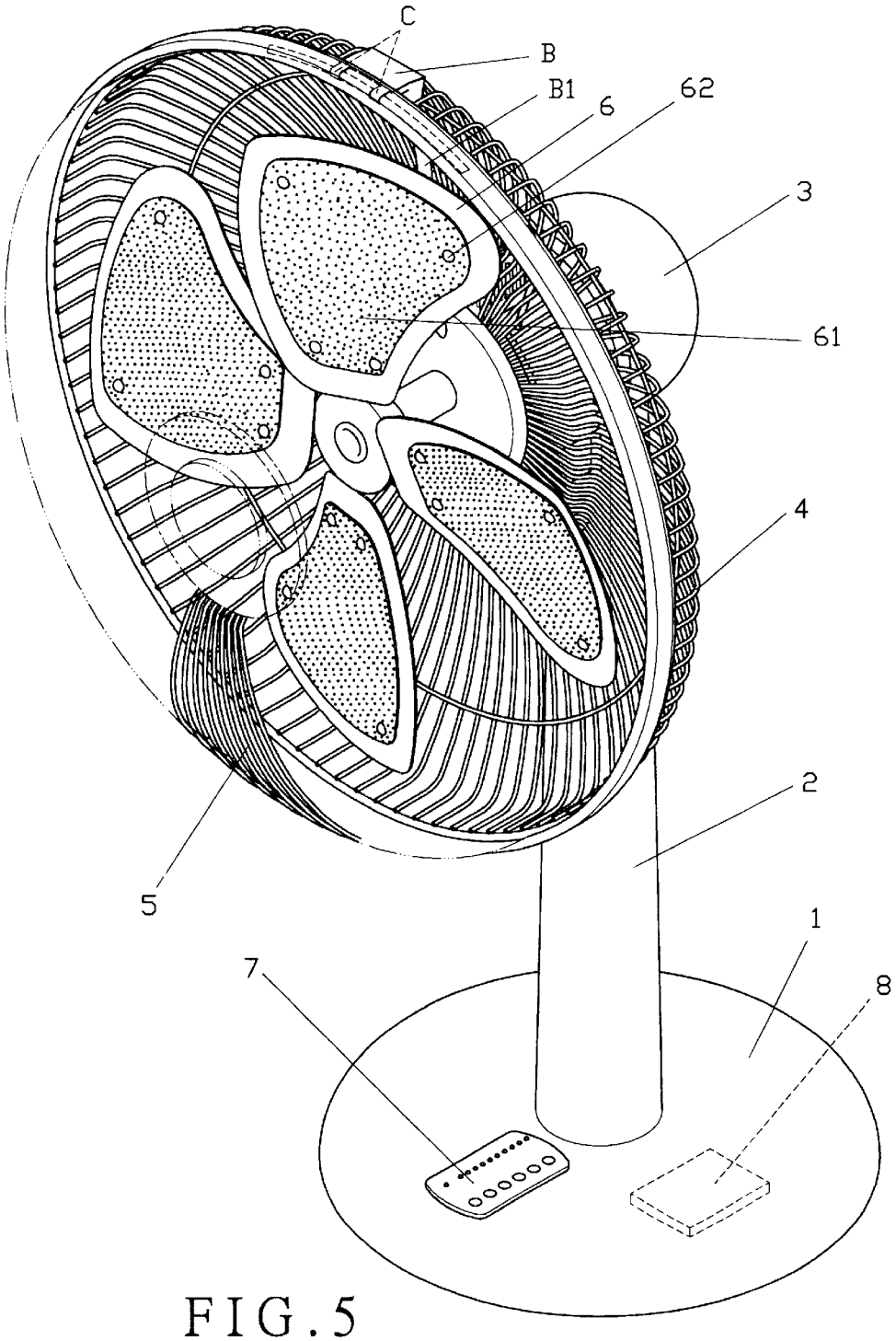
FIG. 5 is a perspective view of another preferred embodiment of the present invention.

Furthermore, as illustrated in FIG. 5, in another preferred embodiment of the present invention, each of the fan blades (6) is hollowed and placed instead a layer of active carbon filter (61) fixed with a plurality of rivets (62) (or in other means) to each fan blade (6). The active carbon filter (61) is made of any basic filter materials as long as it is perforated and adhered with active carbon, e.g. non-woven, fiber, PE or PU foam adhered with active carbon powders or grains or fiber staples. Alternatively, two or more than two layers of any of said filtering material may be used with active carbon powers, grains or fiber staples sandwiched in any feasible ways; or active carbon powders, grains or fiber and pulp may be blended to form a perforated layer.

In addition, the smoke detector (A) on the motor housing (3) may be provided at where appropriately on the screen holder (4), the stand (2) or the base (1). The fan when conducted and is in standby, the operation of the fan must be controlled by the touch panel (7) whether the smoke detector (A) is operating or not.

As disclosed, the electric fan of the present invention by incorporating with a smoke detector to achieve automatic control of the operation of the fan blades by detecting the level of suspended particles present in the ambient air; having an ion generator to emit ions for air purification and providing a safety feature to disconnect the conduction passage once the front screen is removed.

I claim:

1. An electric fan comprising (a) a plurality of fan blades rotatable coupled to a motor, (b) a smoke detector mounted on the fan to detect a level of suspended particles in ambient air, (c) a central control unit wired to the smoke detector and having a control line connected to a switch of the fan to automatically activate rotation of the fan blades responsive to the level of the suspended particles exceeding a predetermined level, and a touch panel electrically coupled to the central control unit to control the operation of the fan.

2. The electric fan as recited in claim 1, further comprising an ion generator provided on a screen holder to emit ions to neutralize substances carrying hazardous cations in the ambient air displaced by rotation of the fan blates.

3. An electric fan comprising;

a first conductor connected to a screen holder of the fan, the first conductor having two contacts extending to an edge of the screen holder;

a second conductor being provided on a rim of a front screen of the fan to form a conduction passage when both the first and second conductors contact each other; and, a central control unit coupled to said first and second conductors, the central control unit disabling operation of the fan responsive to both the first and second conductors being disconnected from each other when the front screen is removed from the fan.

* * * * *